United States Patent [19]

Costa et al.

[11] 4,043,683

[45] Aug. 23, 1977

[54] DISPENSING AND WIPING DEVICE

[75] Inventors: Charles R. Costa, Plainville; Robert L. Smigel, Middletown, both of Conn.

[73] Assignee: Loctite Corporation, Newington, Conn.

[21] Appl. No.: 610,347

[22] Filed: Sept. 4, 1975

Related U.S. Application Data

[63] Continuation-in-part of Ser. No. 481,005, June 20, 1974, abandoned.

[51] Int. Cl.[2] ..... B41F 15/40

[52] U.S. Cl. ..... 401/264; 101/114; 101/123; 101/327; 118/410

[58] Field of Search ..... 101/114, 119, 120, 123, 101/124, 366, 327, 335, 125; 401/145, 158, 163, 170, 171, 172, 176, 179, 264, 261, 148, 265, 266; 222/325, 326, 327, 386; 118/3, 406, 410, 411

[56] References Cited

U.S. PATENT DOCUMENTS

| | | | |
|---|---|---|---|
| 1,606,860 | 11/1926 | Winn | 401/148 |
| 1,926,367 | 9/1933 | Booth | 222/326 X |
| 2,211,312 | 8/1940 | Barlow et al. | 401/170 X |
| 2,457,733 | 12/1948 | Rodman et al. | 118/3 X |
| 2,542,059 | 2/1951 | Rosen | 101/123 |
| 3,889,628 | 6/1975 | Usab | 118/3 |
| 3,949,666 | 4/1976 | Zimmer | 101/123 X |

*Primary Examiner*—Edgar S. Burr
*Assistant Examiner*—R. E. Suter
*Attorney, Agent, or Firm*—Jean B. Mauro

[57] ABSTRACT

A hand-held, manually-operated device for dispensing a viscous liquid in conjunction with a wiping action. Downward pressure on a handle causes expression of viscous material through one or more perforations or orifices in a flexible seal which is in abutting relationship with a surface to which the material is to be applied. As the device is slid across such surface the flexible seal provides both a sealing and a wiping action. When downward pressure is released, an expansion gap is created within the device, thereby relieving expression forces.

10 Claims, 2 Drawing Figures

DISPENSING AND WIPING DEVICE

This is a continuation-in-part of application Ser. No. 481,005, filed June 20, 1974, now abandoned.

BACKGROUND OF THE INVENTION

In recent years stenciled-on gaskets have realized increasing acceptance, replacing the previous die-cut gaskets. This new form of gasketing has been made possible largely through the availability of improved chemical sealant formulations which are capable of being pressed through a stencil to form an appropriate gasket pattern on a surface to be sealed, and are then curable to effect a satisfactory seal. Development of stencil gasketing has been delayed, however, by the unavailability of fully suitable application devices. According to typical prior art procedures an excess of gasketing material is applied to the stencil and is then squeegeed in order to press it through the stencil and deposit it in gasket form on the surface to be sealed. This has resulted in excessive use of material, with attendant loss of economy, and has also required a separate wiping or squeegee operation. The present invention provides a device which simultaneously dispenses an appropriate amount of gasketing material, presses it through a stencil, and wipes the stencil essentially clean without significant waste of material.

SUMMARY OF THE INVENTION

According to the invention there is provided a device for dispensing viscous material comprising a hollow tubular container having an upper and lower end and containing the material to be dispensed and which container at the lower end engages an application means and at the upper end engages a feeding means; a hollow sleeve having an upper and lower end and acting as a handle and mounted slidably over the container and adapted at the upper end to receive and support a feeding means to create compressive forces in the material and thereby cause it to be exuded from the container; a feeding means sealingly mounted at one end of the sleeve which engages one end of the container and extends advancingly thereinto; and an application means to dispense the viscous material onto an abutting surface and simultaneously seal against and wipe the surface, comprising an applicator head which sealingly fits the lower end of the container and having a flexible surface or membrane with at least one perforation or hole therethrough, the perforation communicating with the interior of the container and the flexible surface adapted to simultaneously seal against and wipe an abutting surface. The flexible surface may be fitted into or over the applicator head or may be integral with the applicator head, as in a unitary molding.

More specifically, there is provided a device for dispensing viscous material comprising a hollow tubular container containing the material to be dispensed; a hollow tubular sleeve fitting slidably over the container, on one end of which is mounted an advancing plunger assembly, the plunger of which engages the container at one end and advances thereinto; an application means which fits sealingly on the other end of the container and comprises a unitary structure having a flexible lower surface with a central hole therethrough which communicates with the interior of the container, the flexible surface adapted to simultaneously seal against and wipe an abutting surface. Typically, such abutting surface would comprise the surface of a stencil; however, it will also be appreciated that such surface may also comprise any flat surface having grooves or other depressions therein in which it is desired to deposit a viscous or semi-plastic fluid.

According to the invention there is also provided a process for stencil gasketing comprising contacting the applicator head of the above devices with a stencil in abutting relationship with a surface to be gasketed, depressing the handle, i.e., the sleeve, of the devices and sliding the devices over the stencil, whereby viscous gasketing fluid is dispensed from the devices, pressed through the stencil, and the stencil is simultaneously wiped.

DETAILED DESCRIPTION OF THE INVENTION

Figure 1:
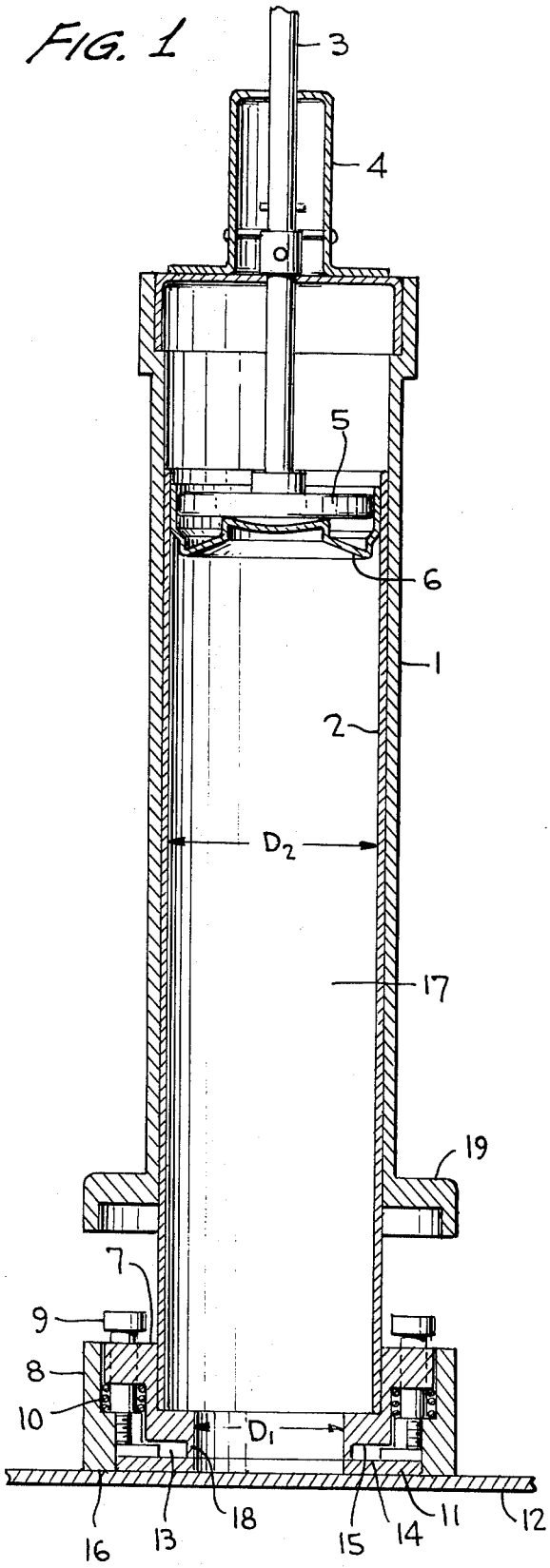
FIGS. 1 and 2 are assembly views of two possible embodiments.

The following description refers to FIG. 1. The material 17 to be dispensed is contained in a hollow, cylindrical tube or cartridge 2, having an inside diameter $D_2$, which acts as a container for the material. Slidably mounted over this container is a hollow sleeve 1 which may be in the form of a cylinder, a cylindrically shaped open framework or other suitable form and which also functions as a handle having a hand rest 19. At one end of said sleeve is mounted a feeding mechanism comprising, typically, a plunger 5 and rod 3 assembly which is capable of advancing axially through the container under the action of a clutch device such as feeding ratchet 4 in order to expel the contents of the container through its lower end. Such a feeding mechanism, or its functional equivalent, are referred to herein as the "feeding means." At the end of the container opposite the feeding mechanism the container engages a seal ring 7, having a shoulder 18, which prevents leakage of the material when extruding force is applied to it and also serves as a mounting member to support an applicator head 8 on which is fixed a flexible seal 11 typically having a circular configuration, and at least one perforation, preferably in its center. The single perforation shown in FIG. 1 has a diameter $D_1$. The applicator head is mounted to the seal ring in a slidable manner by means of a series of shoulder screws 9 on some or all of which are mounted compression springs 10. The applicator head and seal ring are designed so that the applicator head can slide over the seal ring, but the parts are designed such that when there is no compression force on the spring, a small expansion gap 13 exists between facing surface 15 of the seal ring 7 and surface 14 of applicator head 8, respectively. The assembled combination of the seal ring and applicator head comprise the "application means" of this embodiment.

It will be understood that the stencil mentioned herein is not part of the invention. Any suitable stencil may be used, provided that its surface is substantially flat so that good wiping action may be obtained. In using the device of this invention, the stencil will be positioned on the surface of a workpiece on which a gasket or other pattern is to be formed and will be fixed in position by some appropriate means.

In operation, rod 3 is advanced, whereby plunger 5 engages seal 6 in the end of container 2 and ratchet mechanism 4 is engaged to prevent retraction of the rod. However, the plunger is not advanced to such an extent that the material is driven from the opposite end of the container and through the perforation or hole in the flexible seal 11. The device is grasped by sleeve or handle 1 and held in flat, abutting relationship against a stencil 12. Downward force, i.e., toward the stencil, is then applied manually to the sleeve or handle, which exerts sufficient compressive force on the material in the container to cause it to be exuded through the hole in the flexible seal. Because of the pressure applied by plunger 5, only a relatively minor amount of downward force need be applied to the sleeve. However, the downward force, although relatively minor, also exerts compressive force on shoulder 18, which force compresses flexible seal 11 and deflects it downwardly into sealing engagement with stencil 12. As material is exuded through the perforation the device is slid or wiped across the stencil, by which action material is forced through the perforations in the stencil, thereby forming a gasket corresponding to the perforations in the stencil. The stencil is thereafter removed. The flexible seal acts as a wiper or a squeegee, thereby controlling the flow of the material and preventing it from leaking and simultaneously wiping the stencil surface clean. Pressure on the handle overrides the effect of springs 10 thereby compressing them and closing gap 13. When the device has been slid over the entire stencil surface, downward pressure on the handle is released at least partially and sufficiently to permit the springs to expand, thereby restoring gap 13. This action permits the viscous material, which naturally has at least a minor amount of elasticity, to expand slightly, which tends to relieve the exuding forces in the material, thereby terminating the expression of material through the perforations in flexible seal 11. Even after the partial release of pressure on the handle, there is sufficient pressure to maintain the flexible seal in flat abutting relationship with the stencil, whereby the wiping and sealing action of the flexible seal is maintained and the stencil surface is thereby kept clean and free of excess material.

As has been described, downward force on sleeve (or handle) 1 causes material to be expressed. Sleeve 1 and rod 3 are interconnected by a one-way clutch, such as exemplified by ratchet 4, for rectilinear axial movement together only in a feeding direction with respect to container 2, while the sleeve is disconnected from the rod so that the sleeve is free to move in reverse on a retraction stroke while leaving the rod in its position of advancement within the container. Thus, in order to reset the handle for the next downward stroke, it is moved upward on the rod under the action of the ratchet. This manipulation does not change the position of the plunger in the container, so that seal 6 is left in contact with the material and ready for the next downstroke.

The size of gap 13 will be a function of the compressive forces generated in the material in the container, which stresses in turn will be a function of such parameters as the viscosity of the material, the inside diameter $D_2$ of the container and the diameter $D_1$ of the perforation in the flexible seal. The thickness of gap 13 can be readily determined by simple experimentation. However, as a general rule it is suggested that this gap be approximately 1/16 to 3/16 inch, preferably about ⅛ inch.

In order to insure that the flexible seal properly seals to prevent material leakage, it is highly desirable that the flexible seal contact the stencil or other surface before material begins to be expressed, i.e., before any significant downward pressure is applied to the sleeve. In order to accomplish this, the surface of the flexible seal preferably is raised slightly in the area surrounding the perforation or perforations in the flexible seal. While not absolutely essential, sealing will be more efficiently accomplished if the raised area is immediately adjacent to the perforation.

Figure 2:
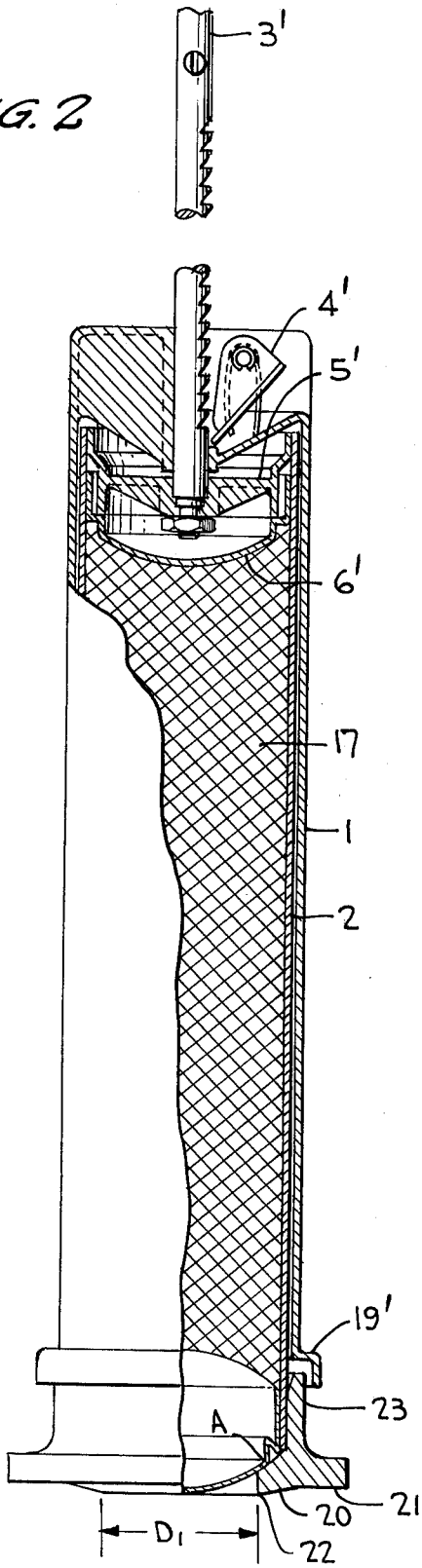

An alternative embodiment is illustrated in FIG. 2. Like numerals correspond to like parts and functions as in FIG. 1, primes having been added to denote slightly different embodiments thereof. The difference, however, is that in FIG. 2 the seal ring, applicator head and flexible seal are eliminated as separate parts and instead are combined into a unitary molded application means 23 which fits snugly and sealingly over the end of container 2. The flexible seal against a stencil or other surface is provided by lip 20 which is raised over surface 21. Edge 22 is broken with a radius, i.e., is rounded. Angle A is preferably approximately 45°. Because of the elimination of mechanical parts, the application means of FIG. 2 is more economical and preferred over that of FIG. 1; however, because of the elimination of the gap/spring configuration, the former is slightly more difficult to use with complete efficiency. It has been found, however, because of the resiliency of the flexible seal, that the natural tendency of lip 20 to resume its raised position after downward pressure on it is released, tends to provide a similar expansion effect as does the gap/spring configuration of FIG. 1. It has been found that with a little practice, completely satisfactory results can be obtained with the embodiment of FIG. 2.

The flexible seal 11 or unitary seal 23 can be fabricated from any material which is flexible and resiliently deformable enough to provide an effective seal and resume its original shape. It should also not be chemically attacked by the material in the container. Typical of suitable materials are butyl rubber, silicone rubber and neophrene, silicone rubber being preferred. The preferred hardness of the flexible sealing material will be about 45 to 65 Durometer, more preferably about 50 to 60 Durometer. Below about 45 the flexible material tends to be pressed into the perforations in the stencil, and above about 65 its sealing and wiping ability are reduced.

The material which may be effectively dispensed by this device will have a viscosity varying from about 50,000 centipoises to about 10,000,000 centipoises or more, preferably about 900,000 to about 8,000,000 centipoises. A particularly useful material is the anaerobic formulation taught by U.S. Pat. No. 3,547,851.

It will, of course, be understood by those skilled in the art that substantial departures from the specific details of the figures can be made without departing from the scope and intent of this invention. For instance, a mechanism could be conceived whereby springs 10 are placed in tension rather than in compression. One could also visualize a device in which handle 1 is advanced under pneumatic force continuously rather than incrementally by hand. Similarly, flexible seal 11 could be stretched over applicator head 8 rather than being recessed therein, as shown. Similarly, the length of sleeve 1 and container 2 may be as long or short as desired.

It will be appreciated that the present device involves the balancing of a number of parameters in achieving its beneficial result of exuding viscous material and simultaneously sealing against its radial outward flow under the same downward force. The optimum design in any particular instance will be arrived at by experiment.

The ratio of $D_2$ to $D_1$ will affect the ability of the device to provide sufficient force to the seal area, e.g., lip 20. For most applications the ratio of $D_2$ to $D_1$ will be between about 1.1 and about 1.6, preferably between about 1.25 and about 1.45, and more preferably between about 1.30 and about 1.40. The viscosity of the material will affect the amount of downward force needed for exudation and therefore the amount of force available for sealing. For instance, an especially low viscosity will require relatively little force, so that an effective seal might not be formed. However, this effect can be counteracted to a certain extent by reducing $D_1$, which tends to concentrate the sealing force available. Similarly, the hardness and configuration of the flexible seal will affect its ability to seal. The hardness has already been discussed. Lip 20 may be raised from about 0.020 to about 0.070 inch or more, preferably from about 0.035 to about 0.60 inch. It has been found that an improved seal capability will be obtained if edge 22 is broken slightly, as by, say, a radius of approximately 0.030 inch. The thickness of the flexible seal or membrane will vary depending primarily upon the material chosen for its fabrication and the design of the sealing area, i.e., the area surrounding the perforations. The important considerations are that the membrane be sufficiently thick to provide the necessary structural integrity but not so thick as to interfere with flexibility. In general, the thickness in the area of the perforations may be about 1/16 to about 3/16 inch, preferably about ⅛ inch.

What is claimed is:

1. A device for dispensing viscous material, said device comprising a hollow tubular container containing the material to be dispensed; a hollow tubular sleeve mounted slidably over the container and which causes said material to be exuded when forced downwardly over the container; a feeding means to apply pressure to the viscous material in the container, said feeding means being mounted on one end of the sleeve and which applies said pressure by advancing into the container; an application means to dispense the viscous material onto an abutting surface and to seal against and wipe said surface, said application means being sealingly mounted on the container at the opposite end of the device from the feeding means, said application means containing a restorable expansion space having biasing means therein to relieve exuding forces in the viscous material, and said application means also having a flexible lower surface with at least one perforation therethrough which communicates with the interior of the container, which flexible surface is caused to be deflected downwardly in the area surrounding the perforation when the sleeve is forced downwardly over the container, and wherein said expansion space is restored by action of said biasing means when the downward force on the sleeve is at least partially released.

2. The device of claim 1 wherein the feeding means is a plunger.

3. The device of claim 1 wherein the flexible surface comprises a rubber.

4. The device of claim 1 wherein the flexible surface has a single perforation.

5. The device of claim 4 wherein the ratio of the inside diameter of the container to the diameter of the perforation in the flexible surface is from about 1.1 to about 1.6.

6. A device for dispensing viscous material, said device comprising a hollow tubular container containing the material to be dispensed; a hollow tubular sleeve mounted slidably over the container and which causes said material to be exuded when forced downwardly over the container; a feeding means to apply pressure to the viscous material in the container, said feeding means being mounted on one end of the sleeve and which applies said pressure by advancing into the container; an application means to dispense the viscous material onto an abutting surface and to seal against and wipe said surface, said application means being sealingly mounted on the container at the opposite end of the device from the feeding means, said application means having molded thereon a flexible lower surface with at least one perforation therethrough which communicates with the interior of the container, which flexible surface is raised in the area surrounding the perforation, and which raised surface compresses against said abutting surface upon application of said downward force and which raised surface tends to resume its raised position, thereby creating an expansion effect in said viscous material, when said downward force on the sleeve is at least partially released.

7. The device of claim 6 wherein the feeding means is a plunger.

8. The device of claim 6 wherein the flexible surface comprises a rubber.

9. The device of claim 6 wherein the flexible surface has a single perforation.

10. The device of claim 9 wherein the ratio of the inside diameter of the container to the diameter of the perforation in the flexible surface is from about 1.1 to about 1.6.

* * * * *